US008538764B2

(12) United States Patent
Jones

(10) Patent No.: US 8,538,764 B2
(45) Date of Patent: Sep. 17, 2013

(54) METHOD AND APPARATUS FOR DELIVERY OF ALIGNED MULTI-CHANNEL AUDIO

(75) Inventor: Anthony Richard Jones, Farnham (GB)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 303 days.

(21) Appl. No.: 13/122,803

(22) PCT Filed: Oct. 6, 2008

(86) PCT No.: PCT/EP2008/063361

§ 371 (c)(1),
(2), (4) Date: Apr. 6, 2011

(87) PCT Pub. No.: WO2010/040381

PCT Pub. Date: Apr. 15, 2010

(65) Prior Publication Data

US 2011/0196688 A1 Aug. 11, 2011

(51) Int. Cl.
*G10L 19/00* (2013.01)

(52) U.S. Cl.
USPC ..... 704/500; 704/201

(58) Field of Classification Search
USPC ..... 704/200–201, 500–504
See application file for complete search history.

(56) References Cited

U.S. PATENT DOCUMENTS

| | | | | |
|---|---|---|---|---|
| 6,356,871 | B1 * | 3/2002 | Hemkumar et al. | 704/500 |
| 6,510,279 | B1 * | 1/2003 | Morishita | 386/203 |
| 6,917,915 | B2 * | 7/2005 | Du et al. | 704/228 |
| 6,937,988 | B1 * | 8/2005 | Hemkumar et al. | 704/500 |
| 7,983,304 | B2 * | 7/2011 | Tatsuta et al. | 370/476 |
| 2001/0014853 | A1 * | 8/2001 | Ishii | 704/201 |
| 2002/0152083 | A1 * | 10/2002 | Dokic et al. | 704/500 |
| 2005/0234731 | A1 * | 10/2005 | Sirivara et al. | 704/500 |
| 2006/0122823 | A1 * | 6/2006 | Yoo | 704/200.1 |
| 2008/0013614 | A1 * | 1/2008 | Fiesel et al. | 375/224 |
| 2011/0196688 | A1 * | 8/2011 | Jones | 704/503 |

* cited by examiner

*Primary Examiner* — Douglas Godbold

(57) ABSTRACT

There is provided a method of encoding audio and including said encoded audio into a digital transport stream, comprising receiving at an encoder input a plurality of temporally co-located audio signals, assigning identical time stamps per unit time to all of the plurality of temporally co-located audio signals and incorporating the identically time stamped audio signals into the digital transport stream. There is also provided a method decoding said encoded data, and encoding apparatus and decoding apparatus.

23 Claims, 6 Drawing Sheets

300 Prior Art

400 Prior Art

METHOD AND APPARATUS FOR DELIVERY OF ALIGNED MULTI-CHANNEL AUDIO

TECHNICAL FIELD

The invention is related to audio coding in general, and in particular to a method and apparatus for delivery of aligned multi-channel audio.

BACKGROUND

Modern audiovisual encoding standards, such as MPEG-1 and MPEG-2, provide means for transporting multiple audio and video components within a single transport stream. Individual and separate audio components are alignable to selected video components. Synchronised multi-channel audio, such as surround sound, are only provided for in terms of a single, pre-mixed surround sound audio component, for example a single Dolby 5.1 audio component. However, there are currently no means provided for individualised multi-channel audio components to be transported in a synchronised form.

In particular, the MPEG-1 and MPEG-2 audio specifications (ISO/IEC 11172-3 and ISO/IEC 13818-3 respectively) describe means of coding and packaging digital audio signals. These include schemes that are specified to support various forms of multi-channel sound that use a single MPEG-2 transport stream component. These provisions are backward compatible with the previous MPEG-1 audio system. In the prior art, it is only by assembling the several audio channels into such a single transport component that it is possible to assure the required synchronisation of the channels. These schemes either require:

[a] the use of surround-sound compression methods (e.g. Dolby 5.1) or

[b] the use of proprietary compression techniques, or

[c] the use of uncompressed audio.

The use of surround-sound compression methods reduces the bit rate required for the multiple channels by exploiting the redundancies that exist between the several channels and also the features of the human auditory system that render certain spatial characteristics of the sound to be undetectable and so may be masked in processing. These complex schemes provide adequate means of dealing with a single coding stage in which only one coding and decoding operation is expected, but they are not ideal for signals that, for practical and operational reasons (e.g. source feeds from a remote location to the central editing facilities), need to be re-encoded perhaps several times in transmission networks. This is due to concatenation issues resultant from multiple coding operations in sequence degrading the audio quality. This is particularly the case where capacity is limited, causing the bit rate to be reduced substantially, leaving little headroom to deal with such degradations in concatenated coding and transmission.

The use of proprietary compression techniques typically require the use of additional external proprietary equipment leading to greater expense and operational complication. This method may also suffer the same quality degradation that concatenation of more than one coding/decoding stage produces.

Whereas, if the audio is sent in uncompressed format (e.g. uncompressed Linear PCM samples), the required data rate is very high data rate (e.g. approx 3 Mbit/s per two-channel pair).

Whilst the above is not generally a problem when providing finalised audiovisual media to consumers, it does present a problem for the audiovisual media production industry, because the industry is increasingly taking advantage of ubiquitous modern high speed data networks to send "raw" audiovisual media (i.e. the source material used to produce television, films and other media) instantaneously in compressed form between production facilities, or indeed from the production facilities out to the television or audio network distribution points, e.g. Terrestrial transmitters, Satellite uplinks or Cable head ends.

For example, location camera crews typically feed audiovisual material to central television studios, for editing and distribution to affiliated television stations for eventual broadcast to viewers. The aforementioned audiovisual encoding standards do not allow synchronised multichannel audio to be sent without pre-mixing, hence adding to the complexity of their field equipment, or preventing them from providing multi-channel audio.

There is a particular need to be able to transmit multi-channel audio that has a requirement for accurate channel-to-channel alignment, such that the audio signals can be subsequently encoded as surround-sound audio where the temporal alignment of multiple channels is important, using the above MPEG standards since a majority of production equipment is already set up for use with these standards.

Accordingly, the present invention proposes methods and apparatus that provide a cost-effective and convenient mechanism for delivering multiple channel audio whilst maintaining sound quality and accurate temporal alignment among the channels.

SUMMARY

Embodiments of the present invention provide a method of encoding audio and including said encoded audio into a digital transport stream, comprising receiving at an encoder input a plurality of temporally co-located audio signals, assigning identical time stamps per unit time to all of the plurality of temporally co-located audio signals, and incorporating the identically time stamped audio signals into the digital transport stream.

Optionally, the step of receiving further comprises sampling the temporally co-located audio signals to form frames of audio data of a predetermined size, and aligning said frames of audio data to maintain the temporal co-location of the audio signals, and wherein the step of assigning identical time stamps is carried out on the aligned frames of audio data.

Optionally, the method further comprises compressing the aligned frames of audio data with identical audio encoder configuration settings prior to assigning the time stamps, and allocating the compressed and identically time stamped audio data to a plurality of mono channels of a transport stream.

Optionally, the plurality of mono channels comprises one or more conventional dual mono audio components.

Optionally, the predetermined size is the size of an Access Unit in the MPEG standard, and the video transport stream is a MPEG-1 or MPEG-2 Transport stream.

Optionally, the time stamps are Presentation Time Stamps.

Optionally, the method of any preceding claim, wherein the step of incorporating the audio into a digital video stream comprises multiplexing the compressed and identically time stamped audio data into a transport stream.

Embodiments of the present invention also provide a method of decoding a digital transport stream including audio encoded according to any of the above encoding methods, comprising receiving a plurality of identically time stamped audio signals, representative of a plurality of temporally co-located individual audio channels, detecting the time stamps to determine shared time stamps, and outputting the plurality of temporally co-located individual audio channels according to the detected timestamps as multiple channels.

Optionally, the plurality of identically time stamped audio signals have been sampled and aligned to form aligned frames of audio data and wherein the identical time stamps have been applied to the aligned frames of audio data.

Optionally, the aligned frames of audio data have been compressed prior to the assignment of the timestamps, and the method further comprises decompressing the frames of audio data to produce the individual audio signals for outputting.

Optionally, the step of outputting the plurality of temporally co-located individual audio channels comprises presenting the audio using the time stamp of only one of the temporally co-located audio signals.

Optionally, the digital transport stream is a digital video transport stream, and the aligned frames of audio data comprise PES packets.

Embodiments of the present invention also provide encoding apparatus adapted to carry out any of the above encoding methods.

Embodiments of the present invention also provide decoding apparatus adapted to carry out any of the above decoding methods.

Embodiments of the present invention also provide a digital transport system comprising at least one described encoding apparatus, at least one described decoding apparatus, and a communications link there between.

Embodiments of the present invention also provide a computer-readable medium, carrying instructions, which, when executed, causes computer logic to carry out any of the described encoding, decoding or both methods.

Embodiments of the present invention further provide an encoding apparatus for encoding audio and producing a transport stream from a plurality of temporally co-located audio channels, comprising at least one encoder for encoding audio according to a predetermined compression, a pack function per encoder, for packing the encoded audio into predetermined portions of audio, an assemble function, adapted to provide identical time stamps to the pack function, for inclusion in a plurality of predetermined portions of audio data such that encoded audio is indicative of the temporal co-location of the audio channels, and a multiplexer for multiplexing together the output of the at least one encoder and pack function pair.

BRIEF DESCRIPTION OF THE DRAWINGS

A method and apparatus for delivery of aligned multi-channel audio will now be described, by way of example only, and with reference to the accompanying drawings in which.

DETAILED DESCRIPTION

Figure 1:
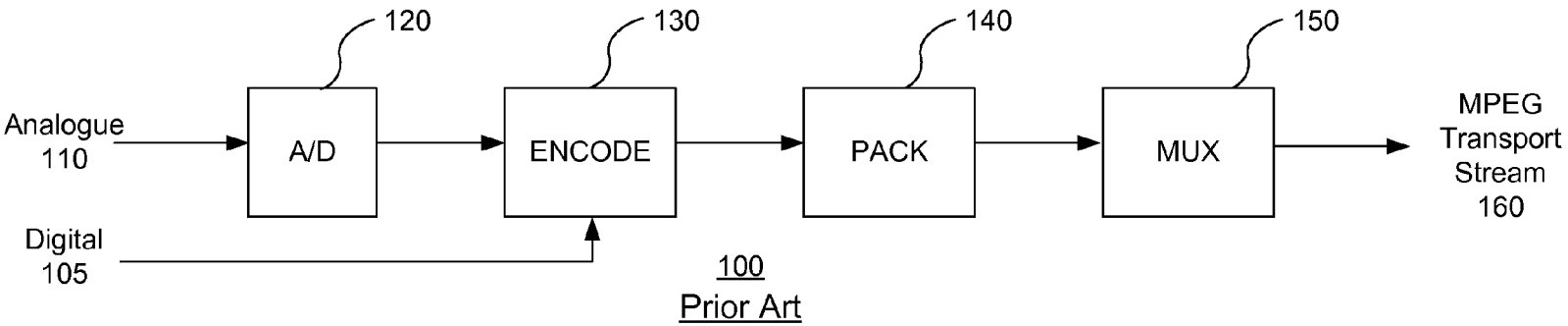
Prior Art FIG. 1
FIG. 1 shows a block diagram schematic of a portion of an analogue or digital mono encoding apparatus according to the prior art.

An embodiment of the invention will now be described with reference to the accompanying drawings in which the same or similar parts or steps have been given the same or similar reference numerals.

The following will be based upon the MPEG-2 standard. However, it will be apparent that the underlying invention is equally applicable to other compressed audio standards that support dual-mono encoding, such as Advanced Audio Coding (AAC), or Dolby Digital.

The MPEG-1 and MPEG-2 audio specifications describe means of coding and packaging digital audio signals. The processed audio data is passed to the MPEG systems layer (ISO/IEC 13818-1) for further packaging into a Transport Stream (TS) before it is transmitted through communication networks such as telecommunications or broadcasting systems. These MPEG packaging rules define a syntax giving structure to the bit streams. In particular, the bit streams contain Time Stamps which are used by the decoder to control the timing of the decoded and restored output audio. These time stamps are used for accurate timing of both the audio and video components.

The MPEG standards define two types of Time Stamp—a Decoder Time Stamp (DTS), which defines when received coded data is to be presented to the decoder, and Presentation Time Stamps (PTS), which define when the decoded audio or video is to be outputted by the system to be heard or seen respectively. It is the latter type of Time Stamp that is most frequently used.

By managing these Time Stamps as described in more detail below, an audiovisual transmission system according an embodiment of the invention is capable of appropriately presenting the several separate audio signals of a multichannel set for encoding or decoding at the same time, thus achieving the required synchronisation between the multi-channel set.

Figure 2:
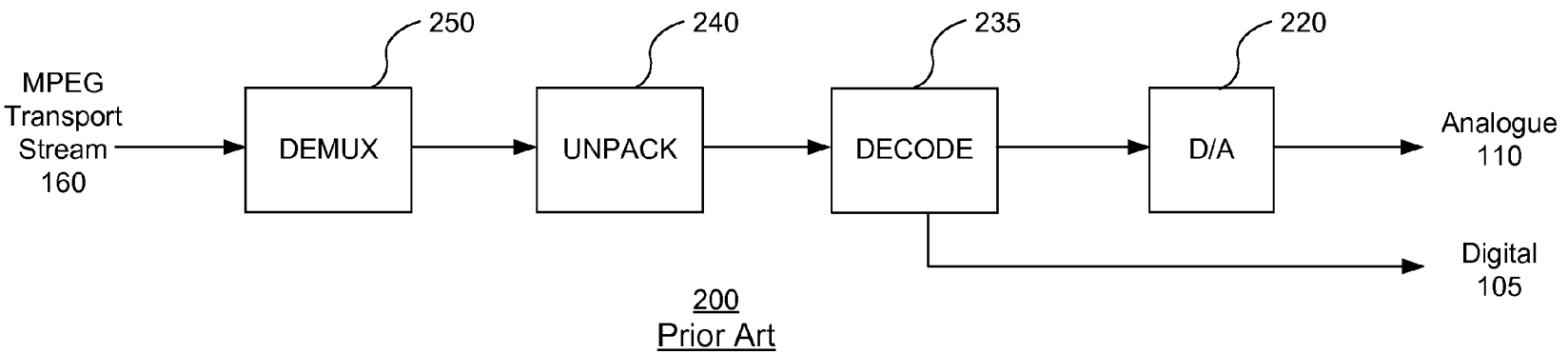
Prior Art FIG. 2
FIG. 2 shows a block diagram schematic of a portion of an analogue or digital mono decoding apparatus according to the prior art.

FIG. 1 shows a block diagram schematic of a portion of an analogue or digital mono encoding apparatus according to the prior art, which illustrates the systematic flow of audio data through an encoding process, such as for example MPEG-2. The decoding process is the reverse process of this, and is shown in FIG. 2.

All the examples in the figures show dual analogue 110 and digital 105 inputs, with the analogue inputs being passed through an Analogue to Digital (A/D) converter 120 for digitisation before being inputted in to the encoder 130. Digital audio 105 is directly inputted into the encoder 130. Separate channels are denoted by labels a-d. However, it will be apparent that the present invention is not limited to any set number of channels, and is completely scalable, and the audio input may be analogue only, digital only, or dual format as shown.

Where the input is in analogue form, the analogue sound is digitally sampled, for example in the form of Linear Pulse Code Modulation (PCM), prior to entry in to the encoder 130, where it is converted into a bit reduced form.

The encoder 130 outputs multiple coded digital bit streams, one for each separate audio channel, into a packing function 140, which packs the audio in to audio samples. Defined groups of audio samples are assembled and associated in the coded domain by blocks of bits called Access Units. Each Access Unit is a packaged up portion of audio, for example a frame of 1152 audio samples.

The separate packed channels are then multiplexed together by multiplexer 150, to form a Transport Stream 160.

The decoding apparatus is shown in FIG. 2, and is essentially the reverse process. The Transport Stream 160 is de-multiplexed by de-multiplexer 250, which provides the packed separate audio channels, for unpacking by unpack function 240, prior to decoding in the decode stage 235 and output as either a direct digital stream 105, or via a Digital-to-Analogue converter 220 into analogue form 110.

Figure 3:
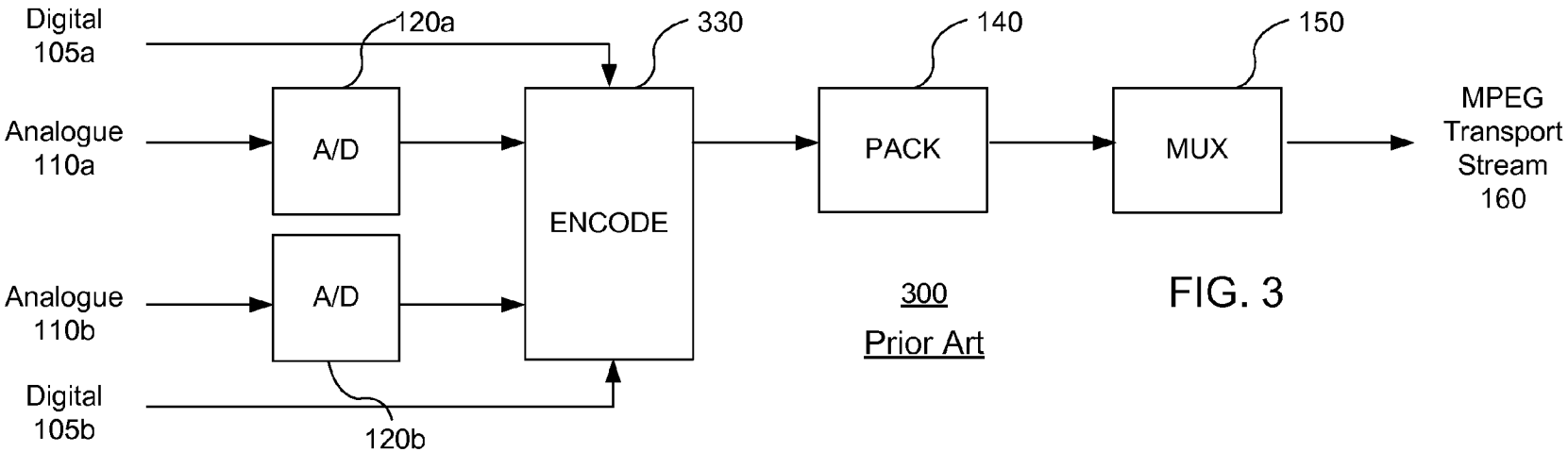
FIG. 3 shows a block diagram schematic of a portion of an analogue or digital stereo or dual mono encoding apparatus according to the prior art.
Figure 4:
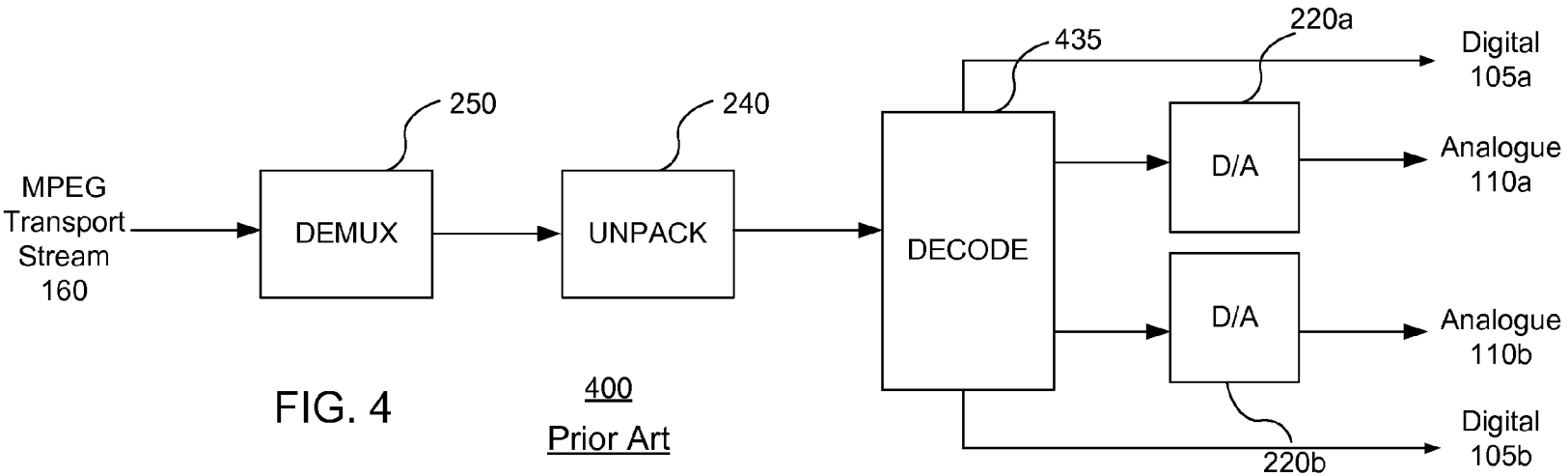
FIG. 4 shows a block diagram schematic of a portion of an analogue or digital stereo or dual mono decoding apparatus according to the prior art.

FIGS. 3 and 4 show the encoding and decoding apparatus for dual mono or synchronised stereo cases. Multiple stereo or dual-mono pairs may be added to a system, but these pairs will not be locked together because the MPEG specification makes no explicit provision for it (other than the surround sound options which suffer the problems described in the background section) and so they remain as separate entities with separate Time Stamps, each being reconstructed independently at the output of the decoder.

A number of independent audio channels, for example different language sound tracks, may exist for inclusion any given Transport Stream, each one being coded separately.

A number of different associations exist between the input audio groups and their coded counterparts, depending on the number of channels required, and the quality criteria and bit rate allocations for each channel chosen by the system operator. The normal mode of operation is that these audio channels are coded independently and no special requirements exist to lock them together.

Some of these channels may be associated with an accompanying video signal (i.e. where the audio is video or television sound) and the system will align these signals with their respective video appropriately using Time Stamps that are common to the Video and Audio streams. The audio alignment in this case is not very precise—it only needs to assure that lip-sync requirements are met. This level of alignment is not as precise as that needed for multi-channel surround sound.

It is normal therefore that each independent monaural audio signal, dual monaural or stereo pair (see FIG. 3) has a separate identity (i.e. elementary stream) within the multiplexed output stream and so each has its own Time Stamp generated independently by the encoding apparatus during the packing stage and is used independently at the decoder.

In brief overview, the proposed solution to the disadvantages of the prior art described above is to adapt the normal MPEG-2 transmission formats used for the standard monaural or two channel stereo channels, by exploiting the timing controls provided for these cases and extending them to that of the multi-channel situation. Thus, decoders according to embodiments of the invention are able to present multiple audio channels exactly aligned, and this then solves the synchronization problem and avoids the concatenation of coding systems and the attendant quality degradation.

The solution is entirely compatible with the existing MPEG-2 syntax and so normal compliant decoders will be able to present the multiple channel audio in the conventional temporal relationship and the method enables its repetition in concatenating systems without fear of quality degradation, albeit without the same degree of alignment precision as a decoder according to an embodiment of the invention.

In more detail, in the proposed multi-channel synchronisation method, the several input audio signals that are required to be treated in a separate and synchronous fashion are processed with the same timing controls such that the same Time Stamps are allocated in the transmission syntax so that a decoder will also maintain the alignment.

Figure 5:
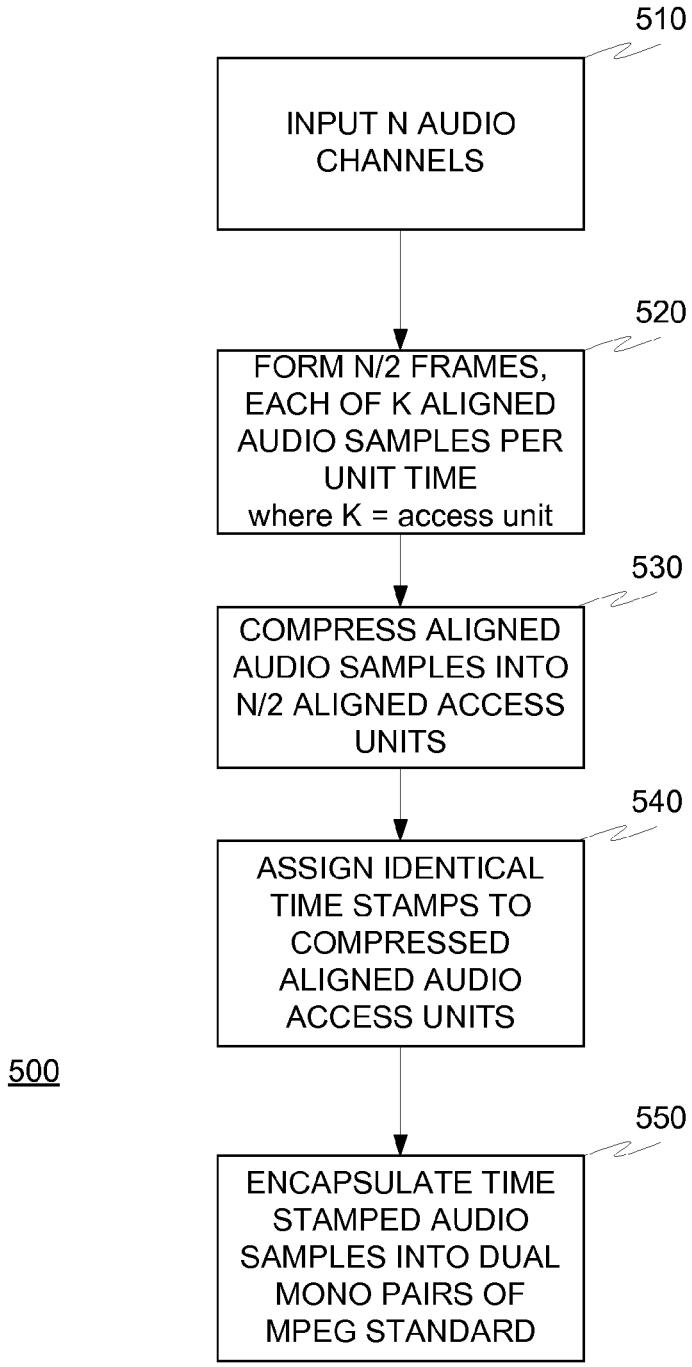
FIG. 5 shows a flowchart of an encoding portion of the method for delivery of aligned multi-channel audio according to an embodiment of the invention.

FIG. 5 shows a portion of an encoding method 500 according to an embodiment of the present invention.

At step 510, a predefined number (N) of independent audio channels, that are to be synchronised and transported over a single Transport Stream without being converted into a single component, are inputted into the encoding apparatus. The encoding apparatus forms K aligned audio samples per unit time, taking one sample from each input audio channel, where the samples correspond to the same instant in time.

The encoding apparatus forms N/2 frames of K aligned audio samples per unit time (step 520), where each frame corresponds to the same original time, but for individual audio channels, ready for compression using the chosen compression method at step 530 to form Access Units, typically using dual-mono audio compression for each pair of audio channels.

The compressed frames (i.e. Access Units) of audio samples are then assigned identical timestamps, typically in the form of a header field, at step 540.

The time-stamped compressed frames of audio samples are encapsulated (i.e. packed) into PES packets containing dual mono pairs of the respective standard in use, e.g. MPEG-2 standard, at step 550. The remainder of the encoding process is the same as for the normal case, i.e. the packed audio is transport packetized and multiplexed with any related video (if applicable), and the other channels, into an output transport stream 160.

Figure 6:
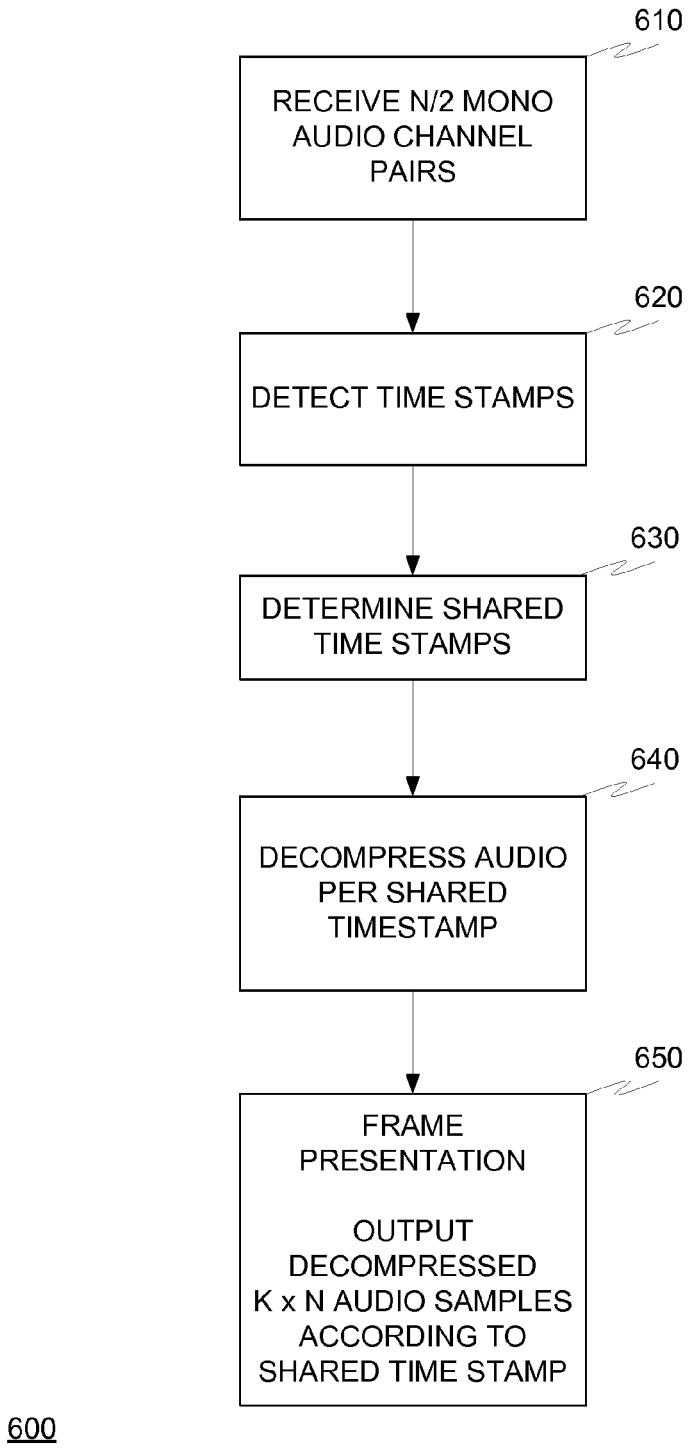
FIG. 6 shows a flowchart of a decoding portion of the method for delivery of aligned multi-channel audio according to an embodiment of the invention.

FIG. 6 shows the reverse decoding process, according to an embodiment of the invention.

In particular, the decoding method comprises receiving N/2 pairs of mono audio channels 610, detecting the time stamps 620, determining which pairs share time stamps 630, decompressing those into N Access Units of mono audio samples relating to the same presentation time 640, and then outputting the decompressed audio to present the N samples at exactly the same time, according to the single common time stamp 650.

It will be apparent that the alignment, compression and time stamp provision may be carried out by a single hardware component of the encoding apparatus, and the reverse processes by a single hardware component of the decoding apparatus.

Figure 7:
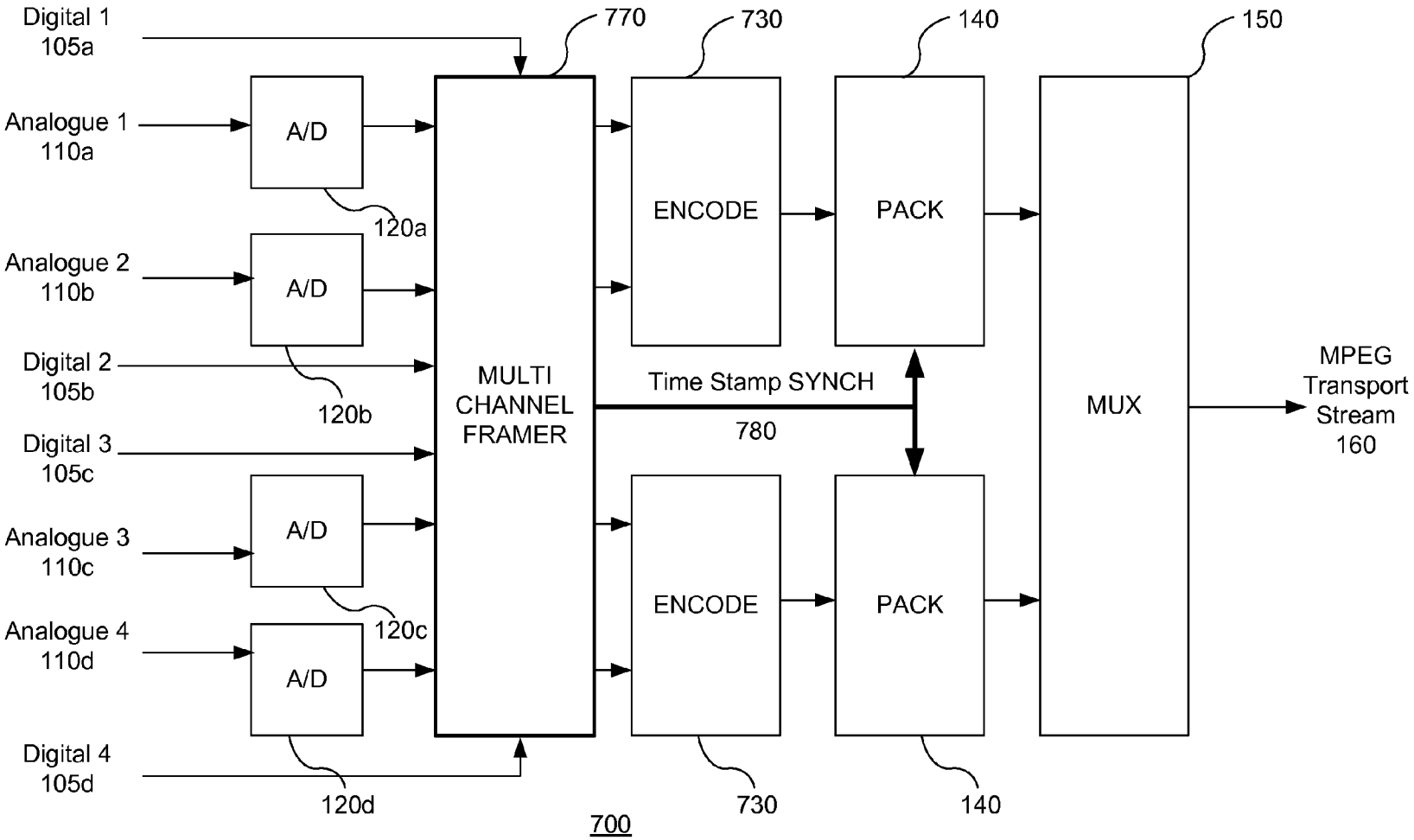
FIG. 7 shows a block diagram schematic of a portion of a multi-channel analogue or digital encoding apparatus according to an embodiment of the invention.

Encoding apparatus for carrying out the above-described encoding method according to an embodiment of the invention is shown in FIG. 7, where it can be seen that there is an additional stage (i.e. multi-channel framing stage 770) of processing provided to align the several audio signals and to arrange and provide for the use of a common Time Stamp between separate, but synchronised, audio channels at the packing stage 140.

The method and apparatus preferably operates by using dual mono channels to carry the separate but synchronised audio channels. Hence, the encoding apparatus of FIG. 7, 700 (and its corresponding decoding apparatus of FIG. 8, 800) is shown with separate encoder/decoder and pack/unpack per pair of audio channels.

FIG. 7 shows an example having four separate audio channels to be synchronised together, with dual (analogue/digital) input capability. Analogue channels are passed through an A/D 120(*a-d*) for digitisation prior to being provided to a framing stage 770. The digital inputs are directly fed into the framing stage 770.

The framing stage 770 creates blocks of temporally co-located audio samples from all audio channels and marks them for processing together with identical time stamps for all the other temporally co-located audio samples. This typically takes the form of a Time stamp synchronisation signal 780, which is passed to the pack stage 140 further down the processing pipeline.

Meanwhile, the audio samples are provided into a standard encoding stage 730 as co-timed frames of dual mono sampled pairs as formed in framing stage 770, which in turn provides the encoded audio samples to the pack stage 140, where they are packed according to the time stamp synchronisation signal 780 provided by the framing stage 770.

A preferred embodiment would use Access Unit sized blocks of samples, and the associated Presentation Time Stamps (PTSs), with the Access Units belonging to multiple channel pairs being compressed using a single Digital Signal Processor, resulting in a set of PES packets with identical PTS values, containing compressed audio relating to exactly co-timed original samples of audio data.

Where there are an odd number of input channels, and dual mono channels are being used as the transport mechanism, then one of the dual mono channels may be simply filled with silence.

The outputs of each of the dual mono chains (encoder and pack function pair) are then multiplexed together in the usual way by multiplexer 150, to provide an output transport stream 160.

Figure 8:
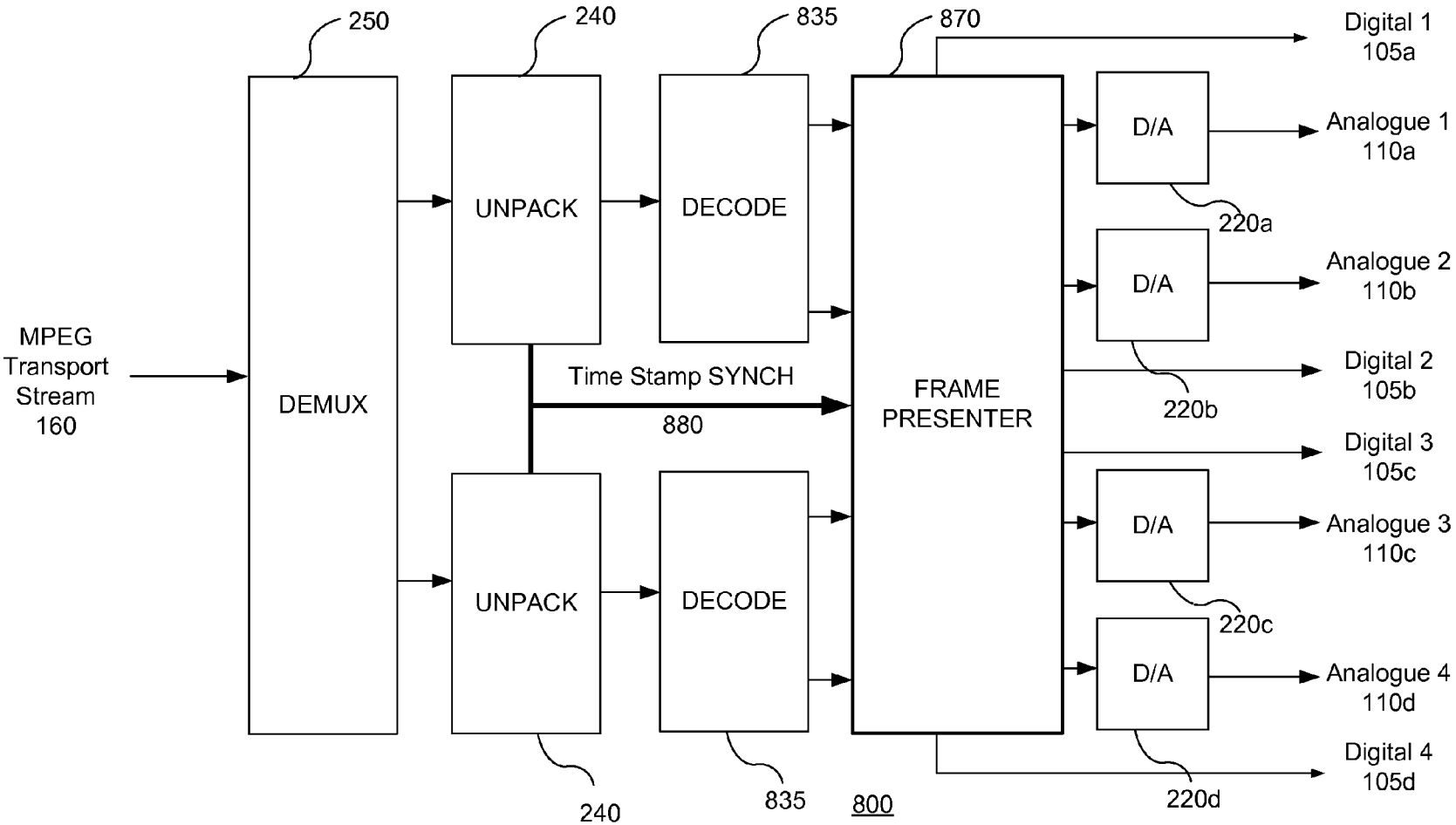
FIG. 8 shows a block diagram schematic of a portion of a multi-channel analogue or digital decoding apparatus according to an embodiment of the invention.

The decoding apparatus 800 according to an embodiment of the invention is shown in FIG. 8

The decode operation decompresses discrete Access Units of audio relating to multiple dual-mono audio components, maintaining their Presentation Time Stamps 835. The frames of decoded samples are then presented by the Frame presentation stage 870 at identical times, according to the common Time Stamp that is shared between them. Thus multiple pairs of samples that relate to the exact co-timed sample time are presented together, hence achieving the aim of maintaining exact channel-to-channel audio alignment across multiple channel pairs through the entire encode/decode processing chain.

Thus the complete scheme for synchronising several channels of audio uses the following features at the encoding apparatus:

- Samples that are temporally co-located at the input across multiple audio channels are formed into aligned frames of audio samples to match the compressed Access Unit sizes.
- The aligned audio frames are compressed with identical audio encoder configurations, preferably allocating two monaural channels (as a pair) to each compressed audio component. However, stereo channels, or individual mono channels may be used as well as, or instead of, the dual mono pair.
- The compressed Access Units are preferably assigned identical Presentation Time Stamp values, or Decoder Time stamps (DTS) with a predetermined time delay.
- The compressed audio components are transmitted as multiple conventional two-channel mono compressed audio components in the MPEG-2 transport stream.

At the decoding apparatus (i.e. receive location):

- Multiple compressed audio components are decoded, with the result being multiple sets (i.e. decoded channels) of de-compressed frames of audio samples having identical time stamps across the channels for any given point in the respective streams.
- The de-compressed audio frames for multiple channels are presented to the output using the Presentation Time Stamp of only one component, such that the output audio samples are temporally co-located (or a predetermined time period after a DTS).

The above described method and apparatus provides means whereby several channels of audio may be transmitted through a communications system such that they remain synchronised to sample accuracy with one another throughout. Previous means of enabling this were limited to stereo pairs and to surround sound coding that leads to quality degradations when multiple stages of coding are concatenated. The present method and apparatus avoids the quality degradations of the prior art systems, and negates the need for more complex and sometimes proprietary surround sound solutions.

Therefore, embodiments of the present invention provide means for "raw" multichannel audio (i.e. not yet mixed into a surround sound form) to be sent across the same Transport Stream as the video to which it relates, thereby reducing degradation in the sound quality due to concatenation and other issues with other, previously known, audio transport methods. This also avoids the need to use lossy surround sound processing prior to transmission or very high bandwidth uncompressed Linear PCM.

The present invention is particularly suited to broadcast quality video transmission which utilises multi-channel audio without converting it into a single component (e.g. 5.1 surround sound). However, it will be apparent that embodiments of the present invention may be equally applied to audio only transport streams, such as those used for delivering multiple channel radio sound or the like.

The present invention is particularly beneficial in systems where compressed audio is being sent for processing into surround sound at another location. This is because when using such compressed sources in surround mixing, misalignment of the compressed audio samples may cause compression artefacts, which in turn may cause undesirable audio impairments in the final surround audio mix.

A typical implementation will comprise encoding apparatus according to an embodiment of the invention at one end of a communications link, and decoding apparatus according to an embodiment of the invention at the other end. Such system pairs may be repeated across multiple communication links, if required.

The above described method maybe carried out by any suitably adapted or designed hardware. Portions of the method may also be embodied in a set of instructions, stored on a computer readable medium, which when loaded into a computer, Digital Signal Processor (DSP) or similar, causes the computer to carry out the hereinbefore described method.

Equally, the method may be embodied as a specially programmed, or hardware designed, integrated circuit which operates to carry out the method on audio data loaded into the said integrated circuit. The integrated circuit may be formed as part of a general purpose computing device, such as a PC, and the like, or it may be formed as part of a more specialised device, such as a games console, mobile phone, portable computer device or hardware audio/video encoder/decoder.

One exemplary hardware embodiment is that of a Field Programmable Gate Array (FPGA) programmed to carry out the described method and/or provide the described apparatus, the FPGA being located on a daughterboard of a rack mounted video server held in a data centre, for use in, for example, a IPTV television system and/or, Television studio, or location video uplink van supporting an in-the-field news team.

Another exemplary hardware embodiment of the present invention is that of an audio and video sender, comprising a transmitter and receiver pair, where the transmitter comprises the encoding apparatus and the receiver comprises the decoding apparatus, where each encoding apparatus is embodied as an Application Specific Integrated Circuit (ASIC).

It will be apparent to the skilled person that the exact order and content of the steps carried out in the method described herein may be altered according to the requirements of a particular set of execution parameters, such as speed of encoding, and the like. Furthermore, it will be apparent that different embodiments of the disclosed apparatus may selectively implement certain features of the present invention in different combinations, according to the requirements of a particular implementation of the invention as a whole. Accordingly, the claim numbering is not to be construed as a strict limitation on the ability to move features between claims, and as such portions of dependent claims maybe utilised freely.

The invention claimed is:

1. A method of encoding audio and including said encoded audio into a digital transport stream, comprising:

receiving, at an encoder input, a plurality of temporally co-located audio signals;

sampling the plurality of temporally co-located audio signals to form a plurality of aligned frames of audio data of a predetermined size, wherein aligned frames of audio data correspond to a same period of time;

compressing the plurality of aligned frames of audio data to create compressed frames;

assigning identical time stamps per unit time to the compressed frames; and incorporating the compressed frames into a plurality of elementary streams of the digital transport stream.

2. The method of claim 1, further comprising wherein the compressing further comprises:

compressing the plurality of aligned frames of audio data with identical audio encoder configuration settings prior to assigning the identical time stamps; and allocating the plurality of aligned frames to a plurality of mono channels of the digital transport stream.

3. The method of claim 2, wherein the plurality of mono channels comprises one or more conventional dual mono audio components.

4. The method of claim 1, wherein the predetermined size is the size of an Access Unit in the MPEG standard, and the video transport stream is a MPEG-1 or MPEG-2 Transport stream.

5. The method of claim 1, wherein the time stamps are Presentation Time Stamps.

6. The method of claim 1, wherein the step of incorporating further comprises:

multiplexing identically time stamped audio data into the digital transport stream.

7. The method of claim 1, wherein the plurality of temporally co-located audio signals further comprise raw multichannel audio.

8. The method of claim 1, wherein the plurality of temporally co-located audio signals are suitable for processing into surround sound.

9. The method of claim 8, wherein the processing into surround sound is performed at another location.

10. The method of claim 1, wherein the plurality of temporally co-located audio signals are components of multichannel surround sound.

11. The method of claim 1, wherein the plurality of temporally co-located audio signals carry separate but synchronized audio channels.

12. A method of decoding a digital transport stream, comprising:

receiving a digital transport stream including encoded audio;

obtaining, from a plurality of elementary streams of the digital transport stream, compressed frames;

decompressing the compressed frames to create a plurality of aligned frames of audio data of a predetermined size representative of a plurality of temporally co-located individual audio channels, wherein aligned frames of audio data correspond to a same period of time;

detecting time stamps of each frame of audio data among the plurality of frames of audio data to determine identically time stamped frames of audio data; and presenting identically time stamped frames of audio data at identical times by using the time stamps of frames of audio data among the plurality of frames of audio data that are representative of one individual audio channel among the plurality of temporally co-located individual audio channels.

13. The method of claim 12, wherein the encoded audio has been sampled and aligned to form the plurality of aligned frames of audio data and wherein the identical time stamps have been applied to the plurality of aligned frames of audio data.

14. The method of claim 12, wherein the digital transport stream is a digital video transport stream, and the plurality of aligned frames of audio data comprise PES packets.

15. An encoder for encoding audio and including said audio into a digital transport stream, the encoder comprising:

a processor;

a non-transitory computer-readable storage medium further including computer-readable instructions, when executed by the processor, are configured to:

receive at an input a plurality of temporally co-located audio signals, sample the plurality of temporally co-located audio signals to form a plurality of aligned frames of audio data of a predetermined size, wherein aligned frames of audio data correspond to a same period of time, compress the plurality of aligned frames of audio data to create compressed frames, assign identical time stamps per unit time to the compressed frames; and incorporate the compressed frames into a plurality of elementary streams of the digital transport stream.

16. The encoder of claim 15, wherein the computer-readable instructions configured to compress, when executed by the processor, is further configured to:

compress the plurality of aligned frames of audio data with identical audio encoder configuration settings prior to assigning the identical time stamps; and allocate the plurality of aligned frames of audio data to a plurality of mono channels of the digital transport stream.

17. The encoder of claim 16, wherein the plurality of mono channels comprise one or more conventional dual mono audio components.

18. The encoder of claim 15, wherein the predetermined size is the size of an Access Unit in the MPEG standard, and the video transport stream is an MPEG-1 or MPEG-2 Transport stream.

19. The encoder of claim 15, wherein the time stamps are Presentation Time Stamps.

20. The encoder of claim 15, wherein computer-readable instructions, when executed by the processor, is further configured to incorporate the audio into a digital video stream by:

multiplexing the plurality of aligned frames of audio data into the digital transport stream.

21. A decoder for decoding a digital transport stream, comprising:

a processor;

a non-transitory computer-readable storage medium further including computer-readable instructions, when executed by the processor, are configured to:

receive the digital transport stream including encoded audio, obtain, from a plurality of elementary streams of the digital transport stream, compressed frames, decompress the compressed frames to create a plurality of aligned frames of audio data of a predetermined size representative of a plurality of temporally co-located individual audio channels, wherein aligned frames of audio data correspond to a same period of time;

detect time stamps of each frame among the plurality of aligned frames of audio data to determine identically time stamped frames of audio data, and present identically time stamped frames of audio data at identical times by using the time stamps of frames of audio data among the plurality of frames of audio data that are representative of one individual audio channel among the plurality of temporally co-located individual audio channels.

22. The decoder of claim 21, wherein the digital transport stream is a digital video transport stream, and the plurality of aligned frames of audio data comprise PES packets.

23. A digital transport system comprising:

an encoder for encoding audio and including the audio into a digital transport stream, the encoder comprising:

a first processor, a first non-transitory computer-readable storage medium further including computer-readable instructions, when executed by the first processor, are configured to:

receive at an input a plurality of temporally co-located audio signals, sample the plurality of temporally co-located audio signals to form a plurality of aligned frames of audio data of a predetermined size, wherein aligned frames of audio data correspond to a same period of time, compress the plurality of aligned frames of audio data to create compressed frames, assign identical time stamps per unit time to the compressed frames, and incorporate the compressed frames into a plurality of elementary streams of the digital transport stream; and a decoder for decoding the digital transport stream, the decoder comprising:

a second processor;

a second non-transitory computer-readable storage medium further including computer-readable instructions, when executed by the second processor, are configured to:

receive the digital transport stream including encoded audio, obtain, from a plurality of elementary streams of the digital transport stream, compressed frames, decompress the compressed frames to create a plurality of aligned frames of audio data of a predetermined size representative of a plurality of temporally co-located individual audio channels, wherein aligned frames of audio data correspond to a same period of time, detect time stamps of each frame of audio data among the plurality of aligned frames of audio data to determine identically time stamped frames of audio data, and present identically time stamped frames of audio data at identical times by using the time stamps of frames of audio data among the plurality of frames of audio data that are representative of one individual audio channel among the plurality of temporally co-located individual audio channels.

* * * * *